US006817269B1

(12) United States Patent
Grace, Jr.

(10) Patent No.: US 6,817,269 B1
(45) Date of Patent: Nov. 16, 2004

(54) EDGE SHARPENER

(75) Inventor: Louis Grace, Jr., North Street, MI (US)

(73) Assignee: G5 Outdoors, L.L.C., Memphis, MI (US)

( * ) Notice: Subject to any disclaimer, the term of this patent is extended or adjusted under 35 U.S.C. 154(b) by 0 days.

(21) Appl. No.: 10/613,170

(22) Filed: Jul. 3, 2003

(51) Int. Cl.[7] ..... B24D 15/08
(52) U.S. Cl. ..... 76/86; 76/82; 451/524
(58) Field of Search ..... 76/82, 86, 87; 451/524, 545, 555, 558

(56) References Cited

U.S. PATENT DOCUMENTS

| | | | | | |
|---|---|---|---|---|---|
| 50,951 | A | * | 11/1865 | Porter | 76/86 |
| 584,933 | A | | 6/1897 | Friedrich | 76/84 |
| 1,069,612 | A | * | 8/1913 | Hale | 76/86 |
| 1,151,627 | A | * | 8/1915 | Taylor et al. | 76/86 |
| 1,255,760 | A | | 2/1918 | Kirlin | 76/86 |
| 1,622,197 | A | | 3/1927 | Keezer et al. | 76/86 |
| 2,038,445 | A | * | 4/1936 | Ransom | 76/86 |
| 2,598,589 | A | * | 5/1952 | Murchison | 451/555 |
| 4,112,790 | A | | 9/1978 | Marder | 76/87 |
| 4,530,188 | A | | 7/1985 | Graves | 76/86 |
| 4,599,919 | A | | 7/1986 | Fortenberry | 76/86 |
| 5,291,805 | A | | 3/1994 | Byers et al. | 76/88 |
| 5,377,563 | A | | 1/1995 | Weeks | 76/86 |
| D365,740 | S | | 1/1996 | Smith | D8/90 |
| 5,679,068 | A | | 10/1997 | Byers et al. | 76/86 |
| 6,142,038 | A | | 11/2000 | Kenesky et al. | 76/86 |
| 6,393,946 | B1 | | 5/2002 | Kenesky et al. | 76/86 |

FOREIGN PATENT DOCUMENTS

| | | |
|---|---|---|
| FR | 650746 | 1/1929 |

OTHER PUBLICATIONS

Brochure; Redi–Edge Pro and Pocket Pro Hunting Knife Sharpener; Klawthorn Industries, Inc., Undated; One Page.
Brochure; "Spee–d Edge"; Spee–d–Edge Manufacturing; Undated; Two Pages.

* cited by examiner

*Primary Examiner*—Hwei-Siu Payer
(74) *Attorney, Agent, or Firm*—Harness, Dickey & Pierce, P.L.C.

(57) ABSTRACT

An edge sharpener for various implements is provided. The edge sharpener includes a sharpener body having a pair of sharpening elements secured to a sharpener body in a fixed angular relationship. The sharpening elements are moveable along this fixed angular relationship to provide a fresh sharpening edge without removal of the elements from the body. The edge sharpener may be provided with precision adjusters for indexing the sharpening element. Further, a removable handle may be provided. By use of sharpening elements of a shape other than rectangular, more than one fixed angular relationship can be provided. Durability of the sharpening edges is enhanced by the form of the edge relief.

41 Claims, 6 Drawing Sheets

EDGE SHARPENER

FIELD OF THE INVENTION

The present invention relates generally to sharpening the cutting edges on implements such as knives, scissors, arrow broadheads and the like, and more specifically to a hand-held sharpening device for such implements. The present invention can sharpen both single and double-sided cutting edges.

BACKGROUND OF THE INVENTION

Since the advent of the use of sharpened implements the need to maintain their edge sharpness has led, over the years, to a myriad of devices and methods to accomplish this task. These devices and methods have accomplished this task with varying a degree of success but have shortcomings as discussed below.

Some sharpening devices such that those disclosed in U.S. Pat. No. 4,112,790 to Marder and U.S. Pat. No. 5,377,563 to Weeks use round sharpening elements which, by virtue of their shape, do not produce a true "V"-shaped edge desired for durability and improved sharpness.

Other sharpening devices such as that disclosed in U.S. Pat. No. 4,530,188 to Graves utilize an abrasive material for the sharpening elements. With this type of material, it is difficult to obtain an exact profile to impart on the edge to be sharpened and to maintain that profile with repeated use.

Still other devices such as that disclosed in U.S. Pat. No. 6,393,946 to Kenesky fail to efficiently utilize the sharpening elements, requiring replacement of the elements when only a small fraction of the edges available has been used.

A further problem with many existing devices is micro-chipping on the working edge of the sharpening elements. Some occurrences of micro-chipping are attributable to carelessness or improper technique on the part of the user. The proper technique is to draw the implement being sharpened toward the body of the sharpener thereby providing greater rigidity and thus minimizing vibration—an important factor to prevent micro-chipping. Another significant factor is the shape of the relief for the working edge in a given application. A radial form relief, or in other words a convex shape, provides the greatest strength, as opposed to a straight bevel relief or a concave relief which prove to be not as strong in this type of application. A further significant factor of micro-chipping is the quality of the material being used for the sharpening elements.

In view of the foregoing background, there is a need in the art to provide an improved edge sharpener that is easy to use while promoting the proper sharpening technique; that is easy to adjust for providing a fresh sharpening edge while efficiently utilizing the sharpening elements; that is versatile in the range of implements that can be sharpened; that can consistently provide a suitable sharpened edge; and that is durable.

SUMMARY OF THE INVENTION

The present invention provides a simple, durable and inexpensive device for sharpening an edge on a variety of implements. The preferred embodiment of the present invention includes a sharpener body having a removable, ergonomically shaped handle extending therefrom. The sharpener body has a pair of bosses for releasably securing a pair of interchangeable sharpening elements to the head in an angled manner so as to provide a V-shaped opening. The bosses are configured to be received within slots formed in each sharpening element and maintain the pair of sharpening elements in a proper angular relationship to provide a fixed included angle for the V-shaped opening. The implement is passed through the V-shaped opening to sharpen its cutting edge.

In one aspect of the present invention, each sharpening element is configured with a pair of opposite edges designed as the sharpening edges. Each edge is arranged to provide a different included angle. For example, one of the sharpening edges is perpendicular to the axis of movement of the sharpening element to provide an first included angle of about 62°, while the opposite sharpening edge is canted at approximately 82° to the axis of movement to provide a second included angle of about 45°. The first included angle of 62° is suitable for any implement requiring a 60° cutting edge included angle since it allows some clearance between the actual cutting edge and the adjacent surfaces of the implement being sharpened. Similarly, the second included angle of 45° is suitable for any implement, such as knives, with a cutting edge included angle between 30° and 40°.

In another aspect of the present invention, the sharpening elements are spaced apart from one another so as not to be in contact, thereby allowing incremental and independent positioning of each element by simply loosening its mounting screw and moving it in its slot. Incremental adjustment of each sharpening element allows utilization of the edges of the sharpening elements along a significant portion of their length, thereby providing a fresh portion of the edge without removing the sharpening elements from the body.

In yet another aspect of the present invention, the sharpener body includes an adjuster to achieve a more precise incremental movement of the sharpening elements. In this aspect, the present invention contemplates the use of one adjustable and one fixed sharpening element, but with both elements being removable, or alternately the use of two adjustable sharpening elements.

In still another aspect of the present invention, the geometry of the sharpening elements are optimized for a given application. In this aspect, each sharpening element is provided with a relief, radial in form, to strengthen the edge and reduce the potential for cracking or chipping. Additionally, the sharpening elements have rounded corners to avoid scratching the surfaces, adjacent to its cutting edge, of the implement being sharpened should the implement be accidentally twisted during sharpening.

In a further aspect of the present invention, the sharpener body has a handle releasably secured thereto. The handle may include a flat surface that allows the user to position the sharpener on a table top or other stable surface to facilitate sharpening. The handle may be removed and interchanged to the opposite side of the sharpener body to facilitate either right- or left-hand usage. Further, the handle may be removed and the body attached separately to another device, such as a hunting bow, for convenience of use in the field. In this configuration, a stabilizer may be secured to the free end of the sharpener body.

Further aspects and areas of applicability of the present invention will become apparent from the detailed description provided hereinafter. It should be understood that the foregoing aspects of the invention, as well as the following detailed description and specific examples, should not be construed to limit the spirit and scope of the present invention.

BRIEF DESCRIPTION OF THE DRAWINGS

The present invention will become more fully understood from the detailed description and the accompanying drawings, wherein.

DETAILED DESCRIPTION OF THE PREFERRED EMBODIMENTS

The following description of the preferred embodiments is merely exemplary in nature and is in no way intended to limit the invention, its application, or uses.

With reference now to the drawings, the present invention is directed to an edge sharpener having a pair of sharpening elements secured thereto in a fixed angular relationship to provide a V-shaped opening through which the edge of the implement to be sharpened is drawn. As presently preferred, the sharpening elements are oriented to provide an fixed included angle therebetween. An included angle of 62° is preferred for any implement, such as some arrow broadhead, with a cutting edge included angle of about 60° since it allows some clearance between the actual cutting edge and the adjacent surfaces of the implement being sharpened. Likewise, an included angle of about 45° is preferred for any implement, such as knives, with a cutting edge included angle between 30° and 40°.

Figure 1:
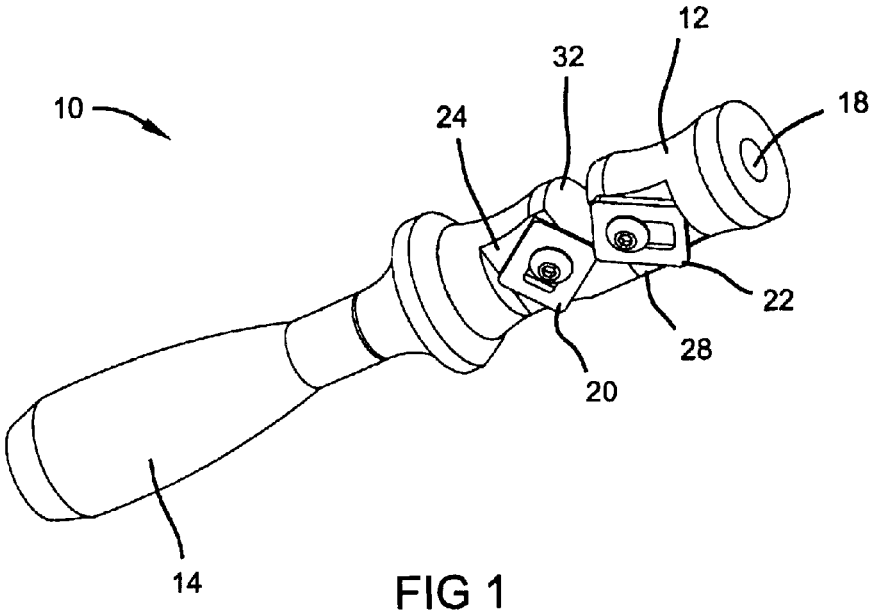
FIG. 1 is an isometric perspective view of the present invention.
Figure 2:
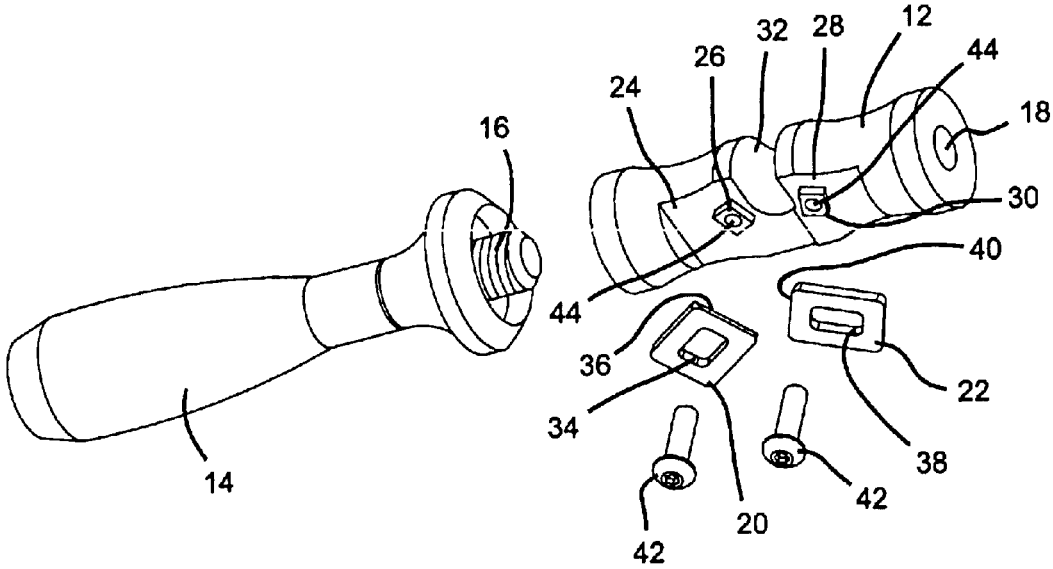
FIG. 2 is an exploded isometric perspective view of the invention shown in FIG. 1.

With particular reference to FIGS. 1–6, a first preferred embodiment of the present invention includes an edge sharpener 10 having a sharpener body 12 and a handle 14 extending therefrom. As best seen in FIG. 2, the handle 14 includes an integral threaded end 16 that is adapted to be received within a threaded aperture 18 formed through sharpener body 12. In this manner, the ergonomically-shaped handle 12 may be releasably secured to either end of the sharpener body 12, facilitating ease and convenience of use for right- or left-handed users, thus promoting the proper sharpening technique. Further, the handle 14 is provided with a flattened bottom surface 19 (as best seen in FIG. 4) on the perimeter of the boss adjacent to the threaded end 16. The sharpener can be positioned with this surface 19 on a rigid surface to stabilize the sharpening process.

Figure 7:
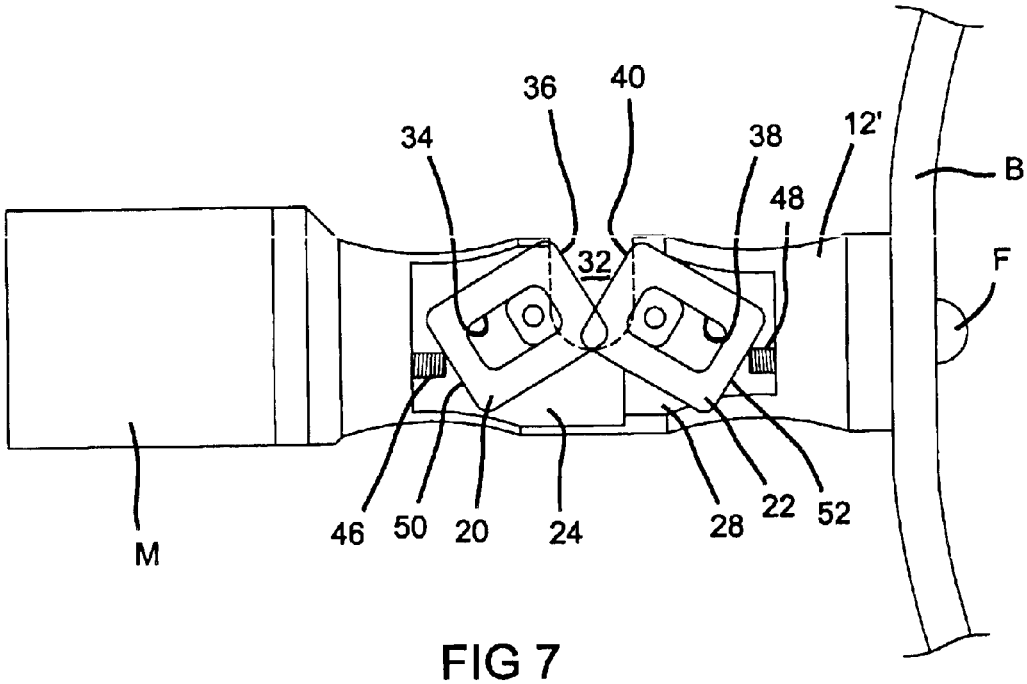
FIG. 7 is an alternate embodiment of the body assembly shown in FIG. 4.

The edge sharpener in accordance with the present invention may be secured to a bow to be readily accessible in the field. Specifically, as seen in FIG. 7, the threaded aperture 18 formed through the sharpener body 12' allows one end of the sharpener body 12' to be secured to a bow B with a threaded fastener F and a stabilizer mass M to be secured on the free end of the sharpener body 12'. In this manner, edge sharpener 10' is interposed between the bow B and the stabilizer mass M. While the fastener F is shown having a head, one skilled in the art will recognize that other fasteners such as a threaded stud may be suitable to secure the sharpener body 12' to the bow B. Furthermore, one skilled in the art will recognized that handle 14 as shown in FIGS. 1–6 could function as the stabilizer mass M shown in FIG. 7 if appropriately weighted.

With reference again to FIGS. 1–6, the sharpener body 12 is adapted to position and hold a pair of sharpening elements 20, 22 in a fixed angular relationship to provide a V-shaped opening through which the edge of the implement to be sharpened is drawn. As best seen in FIG. 2, the sharpener body 12 includes a planar face 24 having a boss 26 extending therefrom and a planar face 28 and having a boss 30 extending therefrom. A recess is formed in the upper surface of the sharpener body to define a window 32. As best seen in FIG. 4, the sharpening elements 20, 22 are secured to the sharpener body 12 such that at least a portion of each sharpening element 20, 22 overlaps each other and the cutting edges 36, 40 define a V-shaped opening having a fixed included angle a in the window 32.

As best seen in the exploded assembly in FIG. 2, each sharpening element 20, 22 has a slot 34, 38 formed therethrough and a sharpening edge of 36, 40 formed thereof. Sharpening element 20 is releasably secured to planar face 24 such that boss 26 is received in slot 34. Similarly, sharpening element 22 is releasably secured to planar face 28 such that boss 30 is received in slot 38. Bosses 26, 30 and slots 34, 38 are sized to maintain a fixed angular relationship between sharpening elements 20, 22. Furthermore, slots 34, 38 are such that the sharpening elements 20, 22 may be slidably positioned along bosses 26, 30 to expose a fresh portion of the sharpening edge 36, 40 formed thereof as best seen by comparing FIGS. 4A and 4B. As presently preferred, a pair of threaded fasteners 42 are received in threaded apertures 44 to releasably secure sharpening elements 20, 22 to the sharpener body 12. While both sharpening elements 20, 22 of the preferred embodiment are shown as being slidably positionable on bosses 26, 30, one skilled in the art will recognized that one or both sharpening elements could be fixedly supported on but removable from its respective boss.

Figure 3:
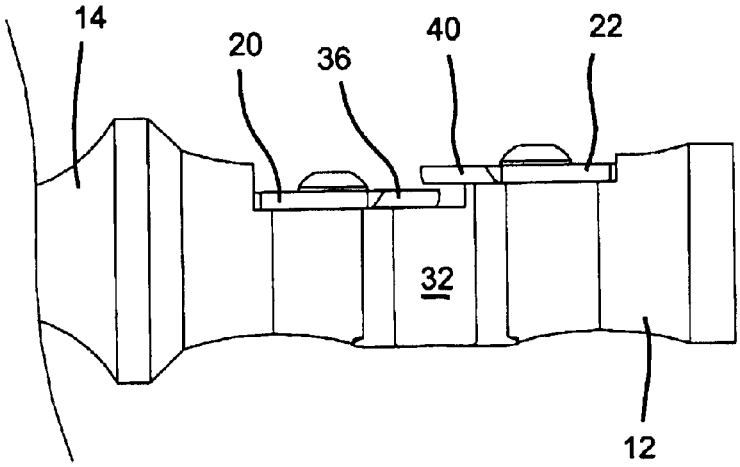
FIG. 3 is a top plan view of the body assembly for the sharpener illustrated in FIG. 1.
Figure 4A:
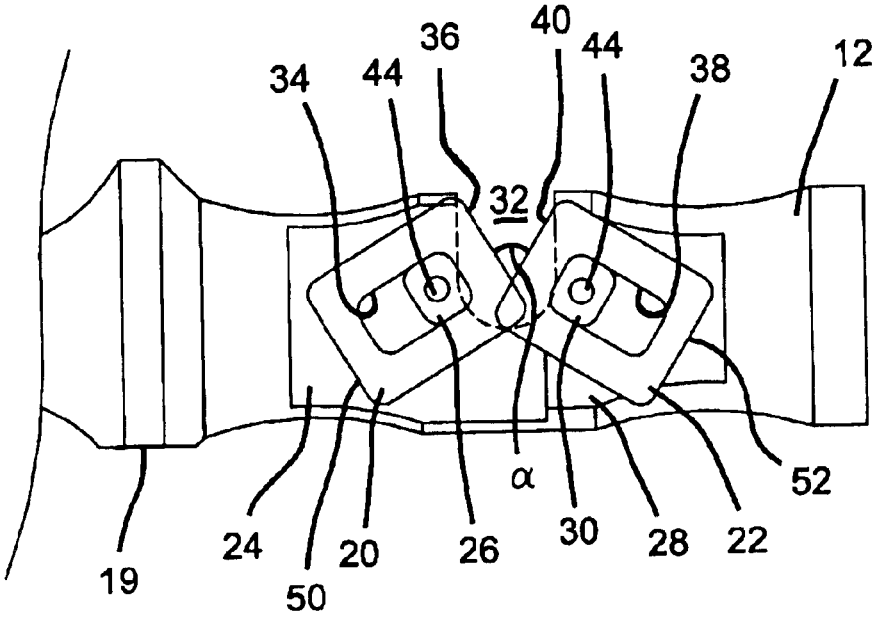
FIG. 4A is a front elevation view of the body assembly for the sharpener illustrated in FIG. 1.
Figure 4B:
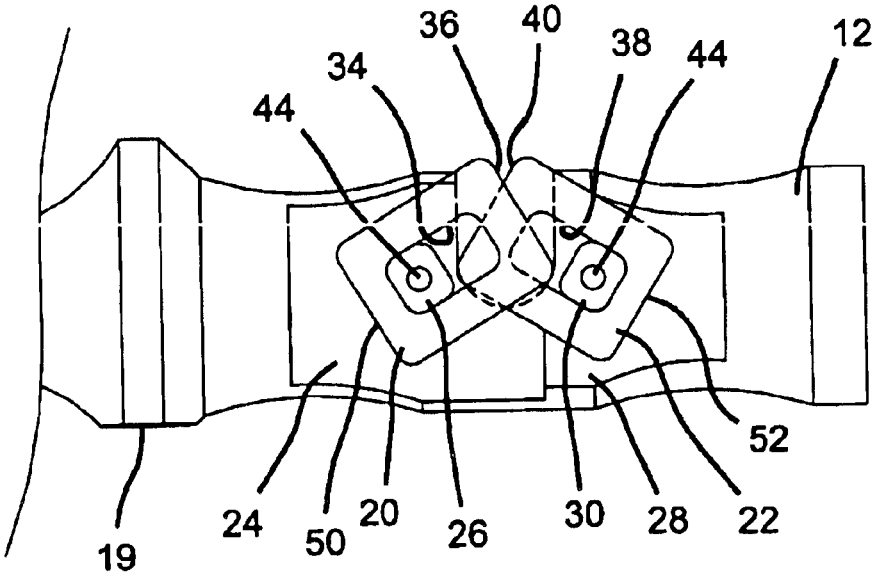
FIG. 4B is a front elevation view similar to FIG. 4A with the sharpening elements adjusted to provide a fresh edge.

As best seen in FIG. 3, planar face 24 which supports sharpening element 20 is formed parallel to but offset from planar face 28 which supports sharpening element 22. In this manner, sufficient clearance is provided between the sharpening elements 20 and 22 in the assembled state to allow each sharpening element to be slidably positioned without requiring disassembly of either sharpening element the sharpener body 12. As presently preferred, a clearance of approximately 0.005" is provided between the sharpening elements 20, 22.

Figure 5A:
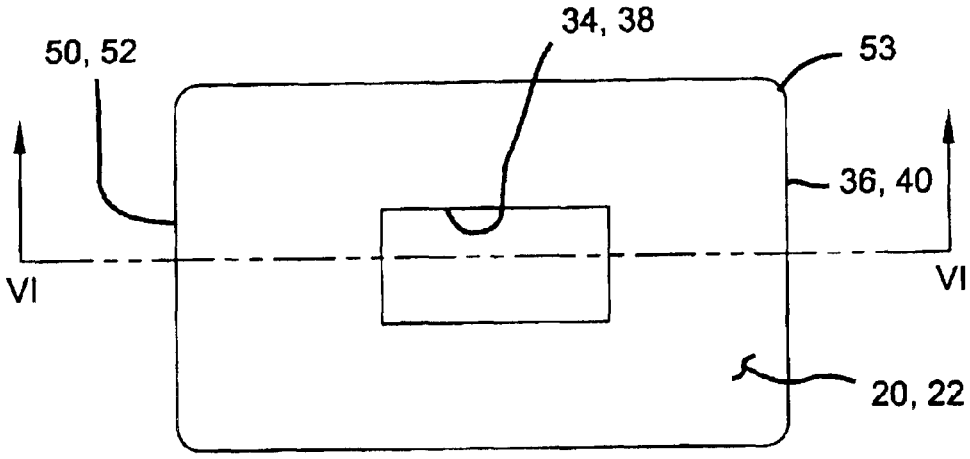
FIGS. 5A–5C show preferred shapes for the sharpening elements of the present invention.
Figure 5B:
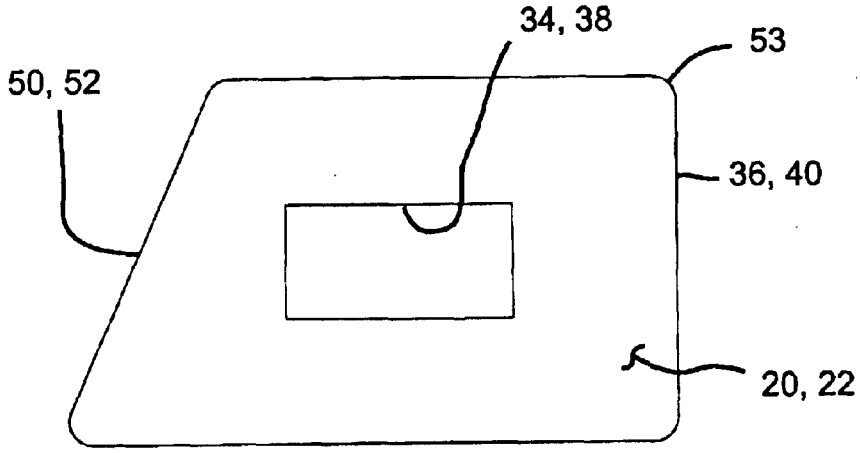
Figure 5C:
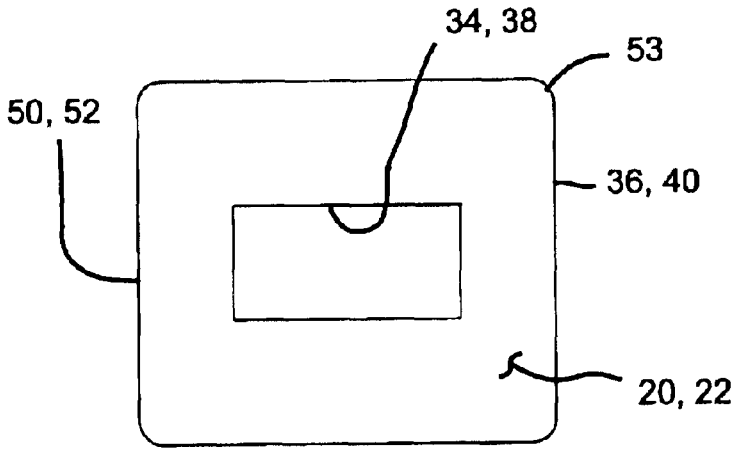

The sharpening elements 20, 22 may take any suitable geometric configuration to provide the fixed included angle. Each sharpening element is preferably formed from a suitable high strength tool grade material, preferably, but not limited, micro-grain or sub micro-grain carbide. Typically, the shape of the sharpening elements 20, 22 in any given sharpener assembly are identical. As such, the sharpening elements 20, 22 are interchangeable such that slot 34 may receive boss 28 and slot 38 may receives boss 26. However, any combination of the shapes can be utilized depending on the given application. In this regard the shapes shown in FIGS. 5A through 5C are merely exemplary in nature and are not intended to limit the invention to the application of these shapes. As can be noted from a comparison of FIGS. 5A–5C, the size, shape and orientation of the slots 34 and 38; the rounded corners 53 of each sharpening element; and the sharpening edges 36, 40 are the same for any given shape. The relative orientation of the second sharpening edge 50, 52 varies to provide different included angles.

For all the shapes shown in FIG. 5A–5C, if sharpening elements 20, 22 are positioned such that cutting edges 36, 40 overlap the window 32, a fixed included angle a of the V-shaped opening of approximately 62° will be established. Likewise, for the shapes shown as FIGS. 5A and 5C, sharpening elements 20, 22 are positioned such that cutting edges 50, 52 overlap window 32, a fixed included angle a of the V-shaped opening of approximately 62° will also be established.

For the shapes shown as FIG. 5B, sharpening elements 20, 22 are positioned such that cutting edges 50, 52 overlap the window, a fixed included angle $\alpha$ of the V-shaped opening of approximately 45° will be established. Alternately, sharpening elements 20, 22 are positioned such that cutting edges 36, 40 overlap the window 32, a fixed included angle a of the V-shaped opening of 62° will be established. In this manner, the edge sharpener 10 equipped with sharpening elements 20, 22 as shown in FIG. 5B may be configured in a first mode with the cutting edges 36, 40 overlapping the window 32 to define an included angle of 62° or configured in a second mode with the cutting edges 50,52 overlapping the window 32 to define a second included angle 45°.

Figure 6A:
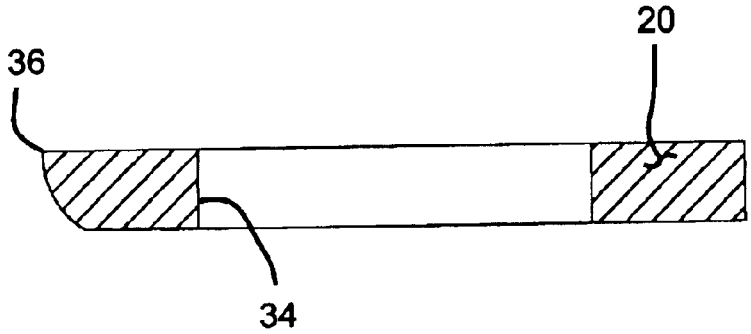
FIGS. 6A–6D show a cross section taken through the sharpening element as indicated by line VI—VI of FIG. 5A showing various forms of relief for the sharpening edge.
Figure 6B:
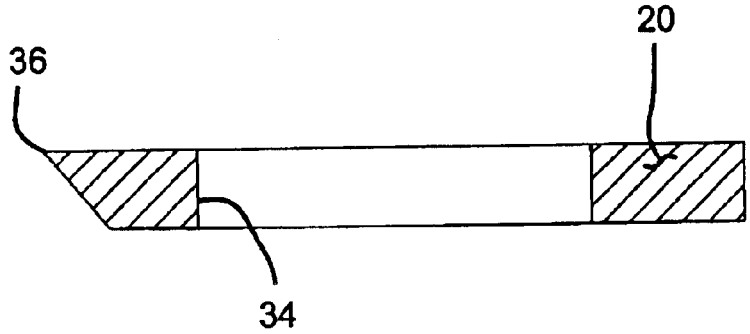
Figure 6C:
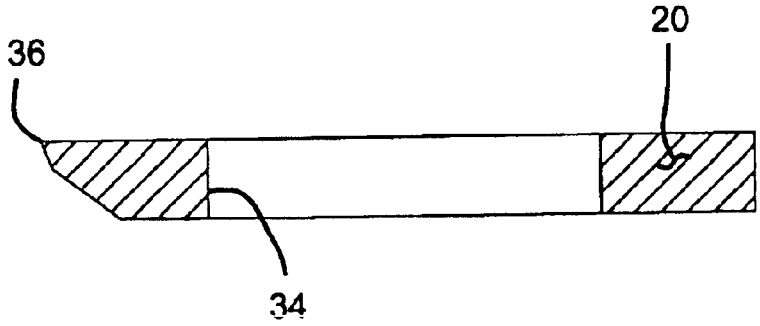
Figure 6D:
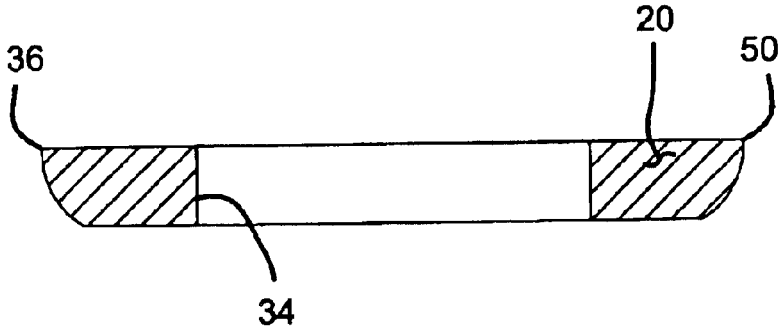

With reference to FIGS. 6A through 6D, the sharpening edges 36, 50 of sharpening element 20 and the sharpening edges 40, 52 of sharpening element 22 are formed by a grinding operation. FIGS. 6A through 60 depict various types of edge relief for the sharpening edges. The preferred relief for this invention is the radial form relief shown in FIG. 6A for a sharpening element with a single sharpening edge 36 and, likewise, in FIG. 6D for a sharpening element with two sharpening edges 36, 50. The preferred relief provides a much stronger sharpening edge than the straight relief or the double angle relief shown in FIGS. 6B and 6C respectively. The radial form relief illustrated in FIGS. 6A and 6D provides a stronger sharpening edge which exhibits reduced tendencies for chipping and micro cracking. Moreover, the process of generating the radial form relief results in much cooler grinding temperatures on the edge so that any damage to the binder in the carbide metallurgy (typically cobalt) is minimized. While the radial form relief is preferred for the above-stated reasons, one skilled in the art will recognize that other edge treatments such as the straight relief and the double angle relief illustrated in FIGS. 6B and 6C may also be utilized.

With reference again to FIG. 7, a modified embodiment of the present invention is illustrated which includes an adjuster which affords precise adjustment to the relative position of sharpening elements 20, 22. Specifically, sharpening body 12' is adapted to receive a pair of threaded elements 46, 48 to locate the sharpening elements 20, 22 respectively. Specifically, threaded adjuster 46 extends longitudinally from sharpener body 12' generally parallel to planar face 24 and is adapted to engage the back edge 50 of sharpening element 20. Similarly, threaded adjuster 48 extends longitudinally from sharpener body 12' generally parallel to planar face 28 and is adapted to engage the back edge 52 of sharpening element 22. Threaded adjusters 46, 48, for adjustment purposes, may be allen-type set screws, thumb wheels or other means of rotating the adjusters without requiring a tool. Alternately, the adjuster may utilize a cam device to achieve the precise adjustment of the relative positions of the sharpening elements.

Figure 8:
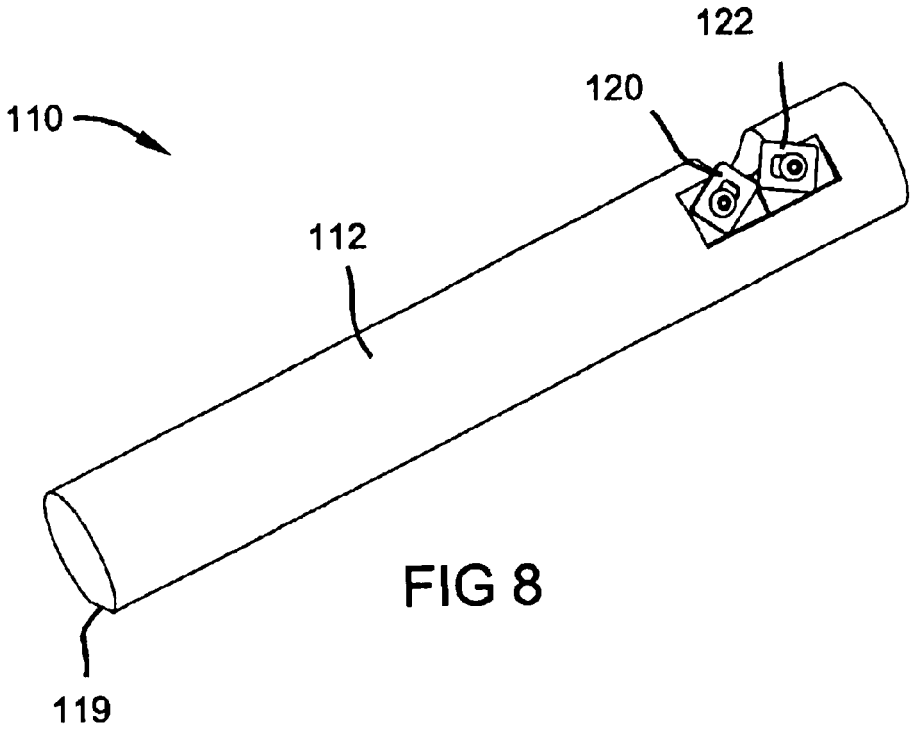
FIGS. 8 and 9 are alternate embodiments of the present invention utilizing a simplified sharpener bodies.
Figure 9:
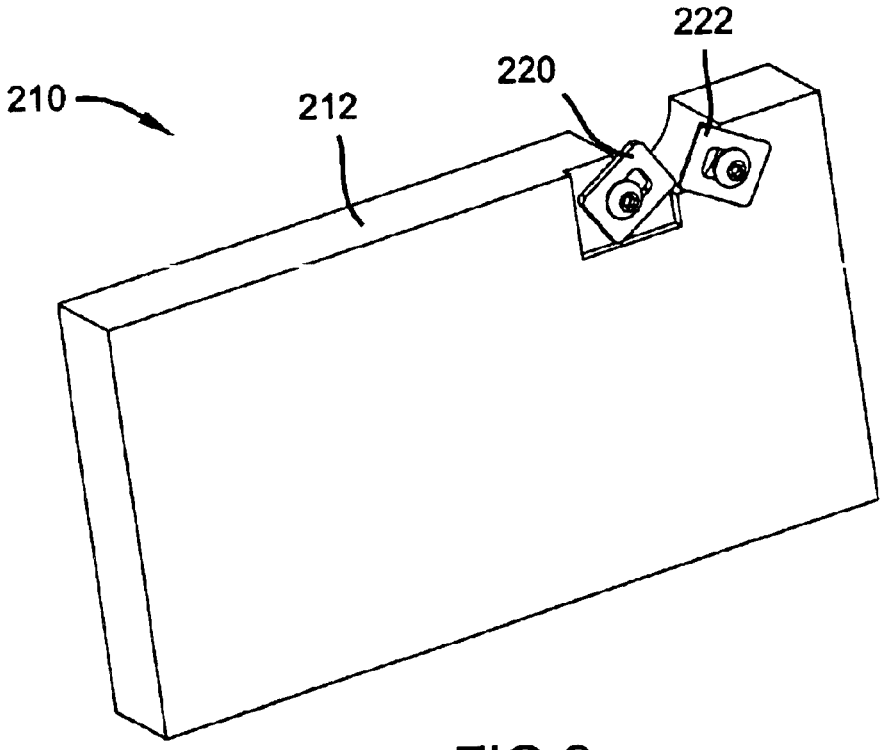

With reference now to FIGS. 8 and 9, the present invention is illustrated in a simplified form that possess all the features of the embodiment shown in FIGS. 1–6 and described heretofore with the exception of the removable handle 14 and the threaded aperture 18 in the body 12.

The edge sharpener 110 shown in FIG. 8 features a solid cylindrically-shaped body 112, such that the handle is integral with the body. The body 112 has a partially flattened bottom portion 119 which functions in a manner similar to flat surface 19 described above. The sharpening elements 120, 122 are secured to body 112 in a fixed angular relationship as heretofore described in reference to sharpening elements 20, 22.

The sharpener 210 shown in FIG. 9 features a solid rectangular shaped body 212 of such a size as to easily fit into a pocket. The sharpening elements 220, 222 are secured thereto in a fixed angular relationship as heretofore described in reference to sharpening elements 20, 22.

From the foregoing descriptions, one skilled in the art will recognize that the present invention provides a compact and efficient apparatus for sharpening a variety of implements. As illustrated, the sharpener of the present invention is shown to provide a fixed included angle between the sharpening elements of approximately 62°. This configuration is determined from the relationship of the bosses of the sharpening body with respect the slots and sharpening edges of the sharpening elements. A fixed angle of 62° is preferred for sharpening implements such as broadheads. By utilizing a second set of sharpening edges on the-sharpening elements, a second included angle can be provided from the same set of sharpening elements. A fixed included angle of approximately 45° is preferred for sharpening knives and other cutlery. Further, the edge sharpener of the present invention may be adapted to provide an edge sharpener for other implements by reconfiguring the relationship of the bosses, slots and/or cutting edges.

The description of the invention is merely exemplary in nature and, thus, variations that do not depart from the gist of the invention are intended to be within the scope of the invention. Such variations are not to be regarded as a departure from the spirit and scope of the invention.

What is claimed is:

1. An edge sharpening apparatus comprising:

a sharpener body having a first planar face with a first boss extending therefrom, a second planar face which is offset from and substantially parallel to said first planar face and has a second boss extending therefrom, and a window formed therein;

a first sharpening element having a first slot and a first cutting edge, said first sharpening element being releasably secured to said first planar face such that said first boss is received in said first slot and at least a portion of said first cutting edge overlaps said window; and a second sharpening element having a second slot and a second cutting edge, said second sharpening element being releasably secured to said second planar face such that said second boss is received in said second slot and at least a portion of said second cutting edge overlaps said window, said first and second cutting edges defining a V-shaped opening having a fixed included angle.

2. The edge sharpening apparatus of claim 1 wherein said first sharpening element is slidably supported on said first boss and positionable thereon to provide a fresh portion of said first cutting edge.

3. The edge sharpening apparatus of claim 2 further comprising an adjuster interposed between said sharpener body and said first sharpening element, said adjuster being positionable to slide said first sharpening element relative to the first boss.

4. The edge sharpening apparatus of claim 3 wherein the adjuster comprises a threaded member extending from said sharpener body.

5. The edge sharpening apparatus of claim 2 wherein said second sharpening element is fixedly supported on said second boss and removable therefrom.

6. The edge sharpening apparatus of claim 2 wherein said second sharpening element is slidably supported on said second boss and positionable thereon to provide a fresh portion of said second cutting edge.

7. The edge sharpening apparatus of claim 6 further comprising an adjuster interposed between said sharpener body and said second sharpening element, said adjuster being positionable to slide said second sharpening element relative to said second boss.

8. The edge sharpening apparatus of claim 7 wherein said adjuster comprises a threaded member extending from said sharpener body.

9. The edge sharpening apparatus of claim 1 wherein said first sharpening element is fixedly supported on said first boss and said second sharpening element is fixedly supported on said second boss, said first and second sharpening elements being removable from said sharpener body.

10. The edge sharpening apparatus of claim 1 wherein each of said first cutting edge and said second cutting edge comprise a radial form relief.

11. The edge sharpener apparatus of claim 1 wherein each of said first and second sharpening elements are rectangular.

12. The edge sharpening apparatus of claim 11 wherein each of said first and second sharpening elements have rounded corners.

13. The edge sharpener apparatus of claim 1 wherein each of said first and second sharpening elements are trapezoidal.

14. The edge sharpening apparatus of claim 13 wherein each of said, first and second sharpening elements have rounded corners.

15. The edge sharpening apparatus of claim 1 further comprising a handle extending from said sharpener body.

16. The edge sharpening apparatus of claim 15 wherein said handle is releasably securable to a first end of said sharpener body for providing a right-handed apparatus and a second end opposite said first end of said sharpener body for providing a left-handed apparatus.

17. The edge sharpening apparatus of claim 15 wherein said handle has a partially flattened bottom surface formed thereon.

18. The edge sharpening apparatus of claim 1 further comprising a fastener securing a first end of said sharpener body to a bow.

19. The edge sharpening apparatus of claim 18 further comprising a stabilizer extending from a second end of said sharpener body.

20. The edge sharpening apparatus of claim 1 wherein said sharpener body is rectangular in shape.

21. The edge sharpening apparatus of claim 1 wherein said sharpener body is cylindrical in shape with a partially flattened bottom surface formed thereon.

22. The edge sharpening apparatus of claim 1 wherein said fixed included angle is approximately 62°.

23. The edge sharpening apparatus of claim 1 wherein said fixed included angle is approximately 45°.

24. An edge sharpening apparatus comprising:

a sharpener body having a first planar face with a first boss extending therefrom, a second planar face which is offset from and substantially parallel to said first planar face and has a second boss extending therefrom, and a window formed therein;

a first sharpening element having a first slot, a first cutting edge and a second cutting edge, said first sharpening element being releasably secured to said first planar face such that said first boss is received in said first slot, at least a portion of one of said first cutting edge and said second cutting edge overlapping said window; and a second sharpening element having a second slot and a third cutting edge and a fourth cutting edge, said second sharpening element being releasably secured to said second planar face such that said second boss is received in said second slot and defines a fixed included angle with said first sharpening element, at least a portion of one of said third cutting edge and said fourth cutting edge overlapping said window.

25. The edge sharpening apparatus of claim 24 wherein said first and second sharpening elements are interchangeable such that said first slot receives said second boss and said second slot receives said first boss.

26. The edge sharpening apparatus of claim 24 wherein the edge sharpening apparatus is configurable in a first mode with said first cutting edge and said third cutting edge overlapping said window to define a first included angle and a second mode with said second cuffing edge and said fourth cutting edge overlapping said window to define a second included angle.

27. The edge sharpening apparatus of claim 26 wherein said first included angle is about equal to said second included angle.

28. The edge sharpening apparatus of claim 26 wherein said first included angle is greater than said second included angle.

29. The edge sharpening apparatus of claim 28 wherein said first included angle is about 62° and said second included angle is about 45°.

30. The edge sharpening apparatus of claim 24 wherein each of said first cutting edge, said second cutting edge, said third cutting edge and said fourth cutting edge comprise a radial form relief.

31. The edge sharpener apparatus of claim 24 wherein each of said first and second sharpening elements are rectangular.

32. The edge sharpening apparatus of claim 31 wherein each of said first and second sharpening elements have rounded corners.

33. The edge sharpener apparatus of claim 24 wherein each of said first and second sharpening elements are trapezoidal.

34. The edge sharpening apparatus of claim 33 wherein each of said first and second sharpening elements have rounded corners.

35. The edge sharpening apparatus of claim 24 further comprising a handle extending from said sharpener body.

36. The edge sharpening apparatus of claim 35 wherein said handle is releasably securable to a first end of said sharpener body for providing a right-handed apparatus and a second end opposite said first end of said sharpener body for providing a left-handed apparatus.

37. The edge sharpening apparatus of claim 35 wherein said handle has a partially flattened bottom surface formed thereon.

38. The edge sharpening apparatus of claim 24 further comprising a fastener securing a first end of said sharpener body to a bow.

39. The edge sharpening apparatus of claim 38 further comprising a stabilizer extending from a second end of said sharpener body.

40. The edge sharpening apparatus of claim 24 wherein said sharpener body is rectangular in shape.

41. The edge sharpening apparatus of claim 24 wherein said sharpener body is cylindrical in shape with a partially flattened bottom surface formed thereon.

* * * * *